US010239686B2

(12) United States Patent
Chatelain

(10) Patent No.: US 10,239,686 B2
(45) Date of Patent: Mar. 26, 2019

(54) CONTAINER FOR CONSUMER GOODS WITH SLIDING PORTION

(71) Applicant: PHILIP MORRIS PRODUCTS S.A., Neuchatel (CH)

(72) Inventor: Lucas Chatelain, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/579,287

(22) PCT Filed: Jun. 23, 2016

(86) PCT No.: PCT/EP2016/064607
§ 371 (c)(1),
(2) Date: Dec. 4, 2017

(87) PCT Pub. No.: WO2016/207310
PCT Pub. Date: Dec. 29, 2016

(65) Prior Publication Data

US 2018/0215530 A1 Aug. 2, 2018

(30) Foreign Application Priority Data

Jun. 26, 2015 (EP) ..... 15174163

(51) Int. Cl.
*B65D 85/10* (2006.01)

(52) U.S. Cl.
CPC ..... *B65D 85/1009* (2013.01); *B65D 85/1054* (2013.01)

(58) Field of Classification Search
CPC . B65D 85/10; B65D 85/1009; B65D 85/1054
(Continued)

(56) References Cited

U.S. PATENT DOCUMENTS 662,560 A * 11/1900 Floyd ..... B65D 85/1009 206/249
3,446,338 A 5/1969 Bozyk
(Continued)

FOREIGN PATENT DOCUMENTS

WO WO 2013/056827 4/2013
WO WO 2013/131616 9/2013
(Continued)

OTHER PUBLICATIONS

PCT/EP2016/064607 International Search Report and Written Opinion dated Aug. 8, 2016 (10 pages).

*Primary Examiner* — Bryon Gehman
(74) *Attorney, Agent, or Firm* — Mueting, Raasch & Gebhardt, P.A.

(57) ABSTRACT

There is provided a container (10) for consumer goods, the container (10) comprising an outer housing comprising a box portion (12) and a lid portion (14) depending from the box portion (12) along a hinge line. The container (10) further comprises a plurality of consumer goods (18) received within the box portion (12) and an inner frame (16) slidably received within the outer housing. The inner frame (16) comprises an inner frame front wall (22) underlying a box portion front wall (17) and a tab portion (28) positioned between a box portion bottom wall and an end of each of a selection of the consumer goods, the tab portion (28) depending along a first weakening zone (30) from the inner frame front wall (22). The tab portion (28) is arranged so that sliding the inner frame (16) away from a box portion bottom wall engages the tab portion (28) with the selection of consumer goods and lifts them away from the box portion bottom wall. An inner wrapper (20) is wrapped around the consumer goods (18), the inner wrapper (20) comprising an
(Continued)

aperture (48) underlying the selection of consumer goods and overlying the inner frame tab portion (28).

11 Claims, 3 Drawing Sheets

(58) Field of Classification Search
USPC ..... 206/249, 254, 255, 268, 273
See application file for complete search history.

(56) References Cited

U.S. PATENT DOCUMENTS

| | | | | | |
|---|---|---|---|---|---|
| 4,664,310 | A * | 5/1987 | Schmidt | B65D 85/1009 | 206/254 |
| 4,942,961 | A * | 7/1990 | Focke | B65D 85/1009 | 206/254 |
| 6,334,532 | B1 * | 1/2002 | Tambo | B65D 85/1045 | 206/268 |
| 8,881,897 | B2 * | 11/2014 | Roila | B65D 85/1009 | 206/254 |
| 2015/0353268 | A1 * | 12/2015 | Novak | B65D 85/1009 | 206/254 |

FOREIGN PATENT DOCUMENTS

| | | |
|---|---|---|
| WO | WO 2013/136425 | 9/2013 |
| WO | WO 2013/164046 | 11/2013 |

* cited by examiner

Figure 3
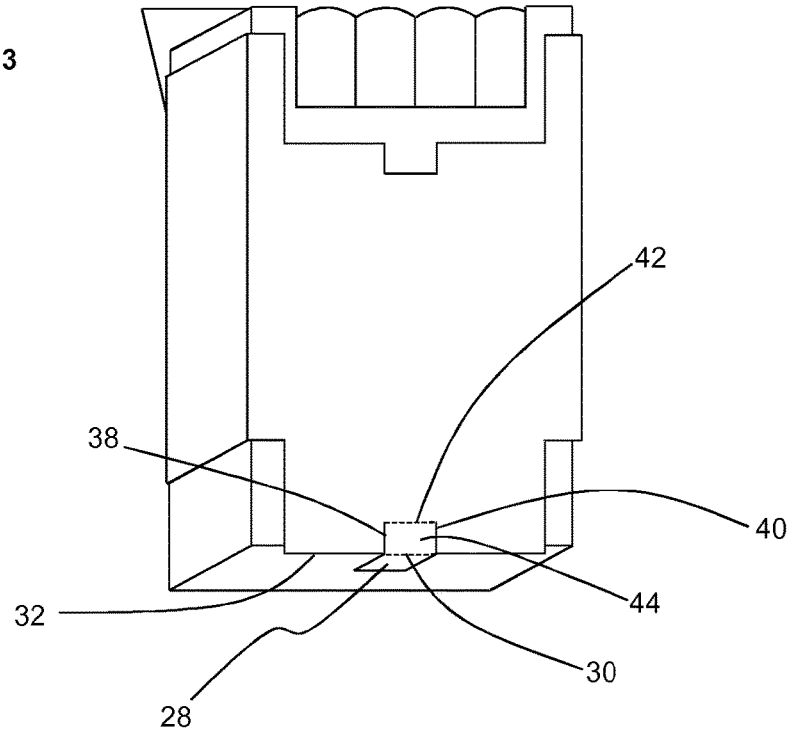
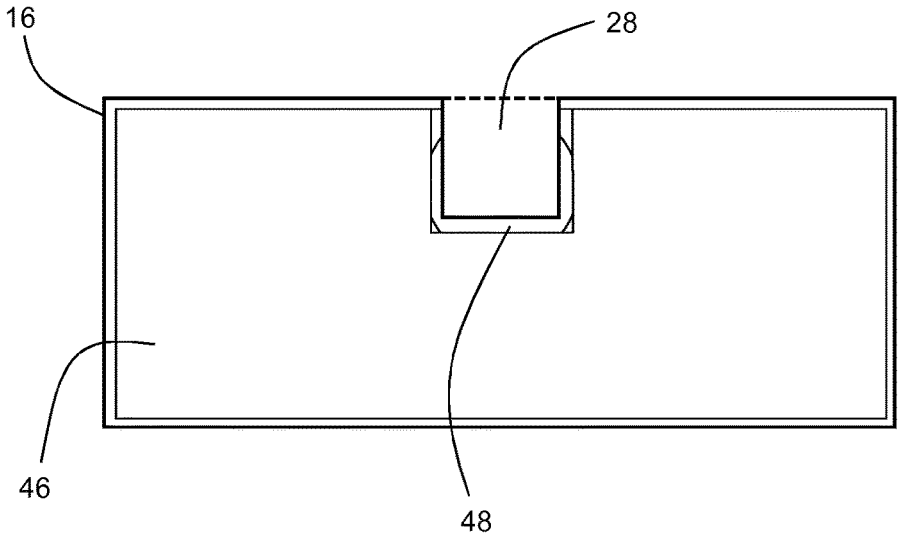
Figure 4

CONTAINER FOR CONSUMER GOODS WITH SLIDING PORTION

This application is a U.S. National Stage Application of International Application No. PCT/EP2016/064607, filed Jun. 23, 2016, which was published in English on Dec. 29, 2016, as International Publication No. WO 2016/207310 A1. International Application No. PCT/EP2016/064607 claims priority to European Application No. 15174163.4 filed Jun. 26, 2015.

The present invention relates to a container for consumer goods, the container comprising a sliding portion. The present invention finds particular application as a container for elongate consumer goods, such as elongate aerosol-generating articles.

Consumer goods such as smoking articles are commonly packaged in rigid box shaped containers, such as hinged lid containers having a box portion and a lid connected to the box portion about a hinge line extending across the back wall of the container, a so called Flip-Top' box. In some cases, the container further includes an inner frame wrapped around at least a portion of the consumer goods. This may provide further rigidity to the container and protect the consumer goods. Where the inner frame extends above an upper edge of the box portion, the inner frame also provides a surface against which the lid can close.

To minimise the amount of material used to form each container and to make each container a convenient size for a consumer, containers are typically only as large as they need to be to contain the desired number of consumer goods. However, in some cases such tight packaging of the consumer goods within the container can make it difficult to remove the first of the consumer goods from the container. For example, in the case of a plurality of smoking articles packaged in a hinged lid container it can be difficult to grasp the end of a smoking article when the container is full.

WO-A-2013/131616 describes a container for rod-shaped items, the container comprising a connecting means connected to the lid, wherein the connecting means is arranged vertically slidable to the box, such that the lid and the connecting means are movable from a lower position to an upper position. The connecting means is adapted to vertically lift at least one rod-shaped item when the lid is moved from the lower position to the upper position.

U.S. Pat. No. 3,446,338 describes a pouch-type package for cigarettes having an ejection mechanism which, when the package is opened, elevates the cigarettes to permit their withdrawal from the package.

It would be desirable to provide an improved container for consumer goods that facilitates removal of the first of a plurality of consumer goods from the container. It would be particularly desirable to provide such a container that is substantially the same size and shape as a conventional container of consumer goods and can be produced using existing high speed manufacturing machines and processes with minimal modification.

According to the present invention there is provided a container for consumer goods, the container comprising an outer housing comprising a box portion and a lid portion depending from the box portion along a hinge line. The container further comprises a plurality of consumer goods received within the box portion and an inner frame slidably received within the outer housing, the inner frame positioned between the plurality of consumer goods and the box portion. The inner frame comprises an inner frame front wall underlying a box portion front wall, and a tab portion depending along a first weakening zone from the inner frame front wall. The tab portion is arranged so that sliding the inner frame away from a box portion bottom wall engages the tab portion with a selection of the plurality of consumer goods and lifts the selection of consumer goods away from a box portion bottom wall.

In the following description of the invention the terms "side", "top", "bottom", "front", "back" and other terms used to describe relative positions of the components of containers according to the invention refer to the container in an upright position with the lid portion at the top. When describing containers according to the present invention, these terms are used irrespective of the orientation of the container being described. In those embodiments in which a lid portion back wall depends from a box portion back wall along a hinge line, the hinge line is located at the back of the container and allows opening of the lid portion by a pivotal movement about the hinge line. The "front" of the container refers to the side of the container opposite the "back" of the container.

The term "height" is used herein to refer to dimensions extending between the top and the bottom. The term "width" is used herein to refer to dimensions extending between two sides. The term "depth" is used herein to refer to dimensions extending between the front and the back. Height, width and depth are orthogonal to each other.

The term "panel" is used herein to refer to a portion of the container formed from a single, continuous portion of material. A panel may depend from one or more other panels. The term "flap" refers to a panel that depends from only one other panel.

The term "wall" refers more generally to a facet of the container, and a wall may be formed from a single panel or flap, or a wall may be formed from two or more abutting or overlapping panels or flaps.

The term "weakening line" is used herein to refer to a line of weakening along which the material in which the weakening line is formed can be folded or broken. For example, a weakening line may comprise at least one of a fold line, a score line, a perforation line and a cut line.

The terms "depend" and "depending" are used herein to refer to a connection between a wall, panel or flap and an adjacent wall, panel or flap. Walls, panels and flaps may depend along one or more weakening lines from an adjacent wall, panel or flap. A wall, panel or flap may depend along a single weakening line from an adjacent wall panel or flap, wherein the wall, panel or flap is typically folded along the single weakening line at an angle of approximately 90 degrees in a substantially parallelepiped container. Alternatively, a wall, panel or flap may depend along multiple weakening lines from an adjacent wall, panel or flap. For example, multiple parallel and coextensive weakening lines may be formed in a laminar blank so that, when the laminar blank is folded along the multiple weakening lines, a substantially rounded or bevelled edge is formed between the adjacent walls, panels or flaps. Alternatively, multiple overlapping but staggered weakening lines may be formed in a laminar blank so that, when the laminar blank is folded along the multiple weakening lines, a twisted edge is formed between the adjacent walls, panels or flaps.

Alternatively, walls, panels and flaps may depend from adjacent walls, panels and flaps along a weakening strip. For example, material may be removed from a surface of a laminar blank using an ablation tool, such as a laser or a blade. The portion of the blank from which the material is removed forms a weakening strip along which it may be easier to deform the blank when the blank is converted into the container. For example, in those containers that may otherwise comprise multiple weakening lines to form a substantially rounded edge between adjacent walls, panels or flaps, the multiple weakening lines may be replaced with a weakening strip having a width corresponding to the total width between the first and last multiple weakening lines. By eliminating discrete weakening lines a weakening strip can form a true rounded edge, whereas a substantially rounded edge formed by multiple weakening lines may retain discernible weakening lines.

The term "weakening zone" is used herein to encompass weakening lines, including fold lines, score lines, perforation lines and cut lines, and weakening strips, including ablated areas.

The term "selection" is used herein to refer to a subset of a total number. Therefore, a selection of consumer goods within a container may be a single consumer good, or the selection of consumer goods may be a plurality of consumer goods up to and including the total number of consumer goods minus one.

By providing a slidable inner frame comprising an inner frame tab portion configured to engage a selection of the consumer goods, containers according to the present invention advantageously provide a convenient means to facilitate the lifting of the selection of consumer goods. Specifically, to facilitate the removal of consumer goods from the container when the container is full, the inner frame can slide away from the box portion bottom wall so that the inner frame tab portion lifts the selection of consumer goods relative to the remainder of the plurality of consumer goods, therefore making it easier to grasp one or more of the consumer goods in the selection of consumer goods. For example, in those embodiments in which the consumer goods are a plurality of elongate smoking articles, lifting the selection of consumer goods raises an end portion of each consumer goods within the selection of consumer goods above the end portions of the adjacent remaining consumer goods. In such embodiments, containers according to the present invention therefore make it easier to grasp the end portion of each of the consumer goods within the selection of consumer goods.

Forming the lifting mechanism using the inner frame also facilitates the manufacture of containers according to the present invention using existing high speed manufacturing machines and processes with minimal modification, such machines typically being already configured for the manufacture of containers comprising a box portion, a lid portion and an inner frame.

The inner frame may comprise first and second side walls each depending from the inner frame front wall. Forming the inner frame with first and second side walls may further facilitate the manufacture of containers according to the present invention on existing high speed manufacturing machines, which are typically configured to handle inner frames comprising a front wall and two side walls.

In addition to first and second inner frame side walls, the inner frame may further comprise an inner frame back wall opposite the inner frame front wall, wherein the plurality of consumer goods are positioned between the inner frame front wall and the inner frame back wall, and wherein the first and second inner frame side walls each extend between the inner frame front wall and the inner frame back wall.

The inner frame back wall may comprise a first inner frame back panel depending from the first inner frame side wall and a second inner frame back panel depending from the second inner frame side wall. The combined width of the first and second inner frame back panels may be less than a width of the inner frame front wall so that the first and second inner frame back panels do not meet and the inner frame comprises a gap extending down a portion of the inner frame back wall. Alternatively, the first and second inner frame back panels may abut or overlap each other so that the inner frame back wall extends across the width of the container between the first and second inner frame side walls.

In embodiments in which the inner frame back wall extends across the width of the container between the first and second inner frame side wall, the inner frame forms a collar surrounding the plurality of consumer goods within the container, which may help to protect the consumer goods within the container and may help to guide the inner frame when the inner frame slides within the box portion.

Preferably, the inner frame back wall is connected to the lid portion so that rotation of the lid portion about the hinge line from a closed position to an open position automatically slides the inner frame upwardly and away from the box portion bottom wall. Therefore, in such embodiments, opening the lid portion will automatically result in the inner frame tab portion lifting the selection of consumer goods to facilitate removal of one or more of the selection of consumer goods from the container.

The inner frame back wall may be connected directly to the lid portion, for example by adhering a portion of the inner frame back wall to the lid portion. Alternatively, the container may comprise one or more intervening portions of material connecting the inner frame back wall to the lid portion. For example, a linkage formed from one or more panels of material may connect the inner frame back wall to the lid portion. The linkage may be formed integrally with and depend from the inner frame back wall, the linkage being adhered to the lid portion. Alternatively, the linkage may be formed integrally with and depend from the lid portion, the linkage being adhered to the inner frame back wall. Alternatively, the linkage may comprise a first portion formed integrally with and depending from the lid portion and a second portion formed integrally with and depending from the inner frame back wall, wherein the first and second portions are adhered together. Alternatively, the linkage may be formed separately and adhered to both of the lid portion and the inner frame back wall.

In those embodiments in which the inner frame comprises first and second inner frame side walls and an inner frame back wall, the inner frame does not comprise a complete inner frame bottom wall extending over the entire area bound by the bottom edges of the inner frame front wall, the first and second inner frame side walls and the inner frame back wall. Forming the inner frame without a bottom wall ensures that, when the inner frame slides upwardly and away from the box portion bottom wall, the inner frame acts only on the selection of consumer goods as a result of the inner frame tab portion engaging the selection of consumer goods. Preferably, the inner frame does not comprise any portion depending from the bottom edges of the first and second inner frame side walls and the inner frame back wall.

In any of the embodiments described above, the container may comprise a retaining mechanism configured to limit the range of sliding motion of the inner frame to prevent the inner frame from sliding entirely out of the box portion when the inner frame slides away from the box portion bottom wall. In those embodiments in which the inner frame comprises an inner frame back wall connected to the lid portion, the connection between the inner frame back wall and the lid portion may also function as the retaining mechanism.

Alternatively, the container may comprise a retaining mechanism that does not form part of a connection between an inner frame back wall and the lid portion. For example, the box portion front wall may comprise an outer box portion front panel and an inner box portion front panel, wherein a top edge of the inner box portion front panel depends along a box portion weakening zone from a top edge of the outer box portion front panel, and wherein a bottom edge of the inner box portion front panel is spaced apart from the box portion bottom wall. In such embodiments, a portion of the inner frame may be configured to engage with the bottom edge of the inner box portion front panel as the inner frame slides upwardly to prevent the inner frame from sliding entirely out of the box portion.

Additionally, or alternatively, the box portion may comprise first and second box portion side walls each comprising an outer box portion side panel and an inner box portion side panel, wherein one or both of the inner box portion side panels comprises an aperture extending through the panel, and wherein a portion of the inner frame is configured to slide within the aperture and engage an end of the aperture as the inner frame slides upwardly to prevent the inner frame from sliding entirely out of the box portion.

In any of the embodiments described above, the inner frame tab portion may depend along the first weakening zone from a bottom edge of the inner frame front wall. Forming the inner frame tab portion so that it depends from a bottom edge of the inner frame front wall may facilitate folding of the inner frame tab portion with respect to the inner frame front wall during manufacture of the container. To accommodate the manufacture of multiple laminar blanks for forming multiple inner frames, the inner frame may comprise a cut-out in the inner frame front wall and extending from a top edge of the inner frame front wall, wherein the cut-out comprises substantially the same size and shape as the inner frame tab portion. In such embodiments, multiple inner frame blanks can be cut from a roll of material with substantially little or no waste material generated, as the inner frame tab portion of each blank forms the cut-out in the consecutive blank. The cut-out in the inner frame front wall extending from the top edge of the inner frame front wall may also further improve access to the selection of consumer goods and facilitate their removal from the container.

In a first set of embodiments, the inner frame tab portion depending from the bottom edge of the inner frame front wall is positioned between the box portion bottom wall and an end of each of the consumer goods within the selection of consumer goods. Preferably, the inner frame tab portion is folded about the first weakening zone through an angle of between about 85 degrees and about 95 degrees with respect to the inner frame front wall so that the inner frame tab portion is substantially parallel to the box portion bottom wall.

Positioning the inner frame tab portion between the box portion bottom wall and an end of each of the consumer goods within the selection of consumer goods ensures that the inner frame tab portion acts upon the ends of the consumer goods within the selection of consumer goods during lifting of the selection of consumer goods, which can advantageously facilitate a reliable contact between the inner frame tab portion and the selection of consumer goods. Positioning the inner frame tab portion between the box portion bottom wall and an end of each of the consumer goods within the selection of consumer goods can also simplify the manufacture of containers according to the present invention, as the inner frame tab portion can be folded along the first weakening zone relative to the inner frame front wall and into contact with the selection of consumer goods after the inner frame front wall has been positioned against the plurality of consumer goods.

The fold angle of the inner frame tab portion with respect to the inner frame front wall may decrease as the inner frame slides upwardly and away from the box portion bottom wall, the decrease in the fold angle resulting from the engagement between the selection of consumer goods and the inner frame tab portion. Therefore, in such embodiments, the decrease in the fold angle of the inner frame tab portion as the inner frame slides upwardly may result in a contact being maintained between the box portion bottom wall and a distal end of the inner frame tab portion distal from the first weakening zone. As the fold angle of the inner frame tab portion with respect to the inner frame front wall decreases, the distal end of the inner frame tab portion may slide across the box portion bottom wall towards the box portion front wall. In some embodiments the inner frame may comprise multiple inner frame tab portions each depending along a weakening zone from the bottom edge of the inner frame front wall. In such embodiments, the multiple inner frame tab portions may have different lengths so that the rate at which the fold angle decreases as the inner frame slides upwardly varies between the inner frame tab portions. This may advantageously result in multiple selections of consumer goods that are each raised to a different height with respect to the remainder of the consumer goods.

In some embodiments, the container may further comprise an inner wrapper wrapped around the plurality of consumer goods. In those embodiments in which the inner frame tab portion is positioned between the box portion bottom wall and an end of each of the consumer goods within the selection of consumer goods, the inner wrapper may comprise an aperture underlying the selection of consumer goods and overlying the inner frame tab portion so that the inner frame tab portion can contact the selection of consumer goods through the aperture when the inner frame slides away from the box portion bottom wall.

The aperture may be substantially the same size as the box portion bottom wall so that none of the inner wrapper is positioned between the plurality of consumer goods and the box portion bottom wall. That is, the inner wrapper may lack an inner wrapper bottom wall.

Alternatively, a portion of the inner wrapper may be positioned between some of the plurality of consumer goods and the box portion bottom wall to define an inner wrapper bottom wall, and wherein the aperture is an aperture in the inner wrapper bottom wall.

Alternatively, instead of an aperture in the inner wrapper, the inner wrapper may comprise a portion positioned between the plurality of consumer goods and the box portion bottom wall to define an inner wrapper bottom wall, the inner wrapper comprising at least one weakening zone defining a movable flap within the inner wrapper bottom wall, and wherein the movable flap underlies the selection of consumer goods and overlies the inner frame tab portion so that the inner frame tab portion can push the movable flap against the selection of consumer goods when the inner frame slides away from the box portion bottom wall. Forming a movable flap instead of an aperture may simplify the manufacture of the container by eliminating the need to remove waste material when forming the inner wrapper.

The at least one weakening zone defining the movable flap may be substantially U-shaped, such as a substantially U-shaped cut in the inner wrapper bottom wall. Additionally, or alternatively, at least a portion of the at least one weakening zone may extend onto an inner wrapper front wall underlying the box portion front wall.

In a further alternative, the inner wrapper may comprise two substantially parallel cut lines spaced either side of the inner frame tab portion to define a deformable portion of the inner wrapper, wherein the inner frame tab portion pushes the deformable portion of the inner wrapper against the selection of consumer goods to lift the selection of consumer goods when the inner frame slides upwardly and away from the box portion bottom wall.

In any of the embodiments described above in which the inner frame tab portion depends along the first weakening zone from the bottom edge of the inner frame front wall, the inner frame may further comprise second and third weakening zones each extending from the first weakening zone and across a portion of the inner frame front wall. Providing such second and third weakening zones can facilitate the folding, crushing or collapsing of the portion of the inner frame front wall from which the inner frame tab portion depends in the event that the inner frame tab portion interferes with another portion of the container, such as the box portion bottom wall, when the inner frame slides back down towards the box portion bottom wall.

The second and third weakening zones may each comprise a cut extending into the inner frame front wall, wherein each cut extends from an end of the first weakening zone so that a width between the cuts at the first weakening zone is the same as a width of the inner frame tab portion at the first weakening zone. In such embodiments, each of the cuts may comprise a distal end distal from the first weakening zone, the inner frame further comprising a fourth weakening zone extending between the distal ends of the cuts forming the second and third weakening zones. Preferably, the fourth weakening zone comprises at least one of a score line, a fold line, a perforation line and an ablation line.

In any of the embodiments described above, the inner frame front wall may comprise a maximum height between a top edge of the inner frame front wall and the bottom edge of the inner frame front wall, wherein the maximum height of the inner frame front wall is between 70 percent and 130 percent of a maximum height of the box portion front wall between a top edge of the box portion front wall and a bottom edge of the box portion front wall. Forming the inner frame with a front wall having a maximum height within this range can allow the container to be configured so that when the inner frame is in a lowered position representative of a typical position of an inner frame in a conventional hinge lid box, the bottom edge of the inner frame front wall abuts the box portion bottom wall. Therefore, in such embodiments, the container is configured so that, after sliding the inner frame upwardly to lift the selection of consumer goods, a consumer can easily and reliably return the inner frame to the natural lowered position by sliding the inner frame downwardly until the bottom edge of the inner frame front wall abuts the box portion bottom wall.

In a second set of embodiments, the inner frame tab portion may be positioned between the inner frame front wall and the selection of consumer goods, instead of being positioned between the box portion bottom wall and an end of each of the consumer goods within the selection of consumer goods. In such embodiments, the inner frame tab portion is arranged to engage an intermediate portion of each of the selection of consumer goods when the inner frame slides upwardly and away from the box portion bottom wall.

In those embodiments in which the inner frame tab portion is positioned between the inner frame front wall and the selection of consumer goods, the inner frame tab portion may be folded about the first weakening zone through an angle of between about 175 degrees and about 180 degrees with respect to the inner frame front wall so that the inner frame tab portion is substantially parallel to the inner frame front wall.

The inner frame tab portion may depend along the first weakening zone from a bottom edge of the inner frame front wall. Alternatively, the inner frame may comprise a second weakening zone in the inner frame front wall and extending between first and second ends of the first weakening zone, so that the inner frame tab portion is defined by an area surrounded by the first and second weakening zones. For example, the first weakening zone may comprise at least one of a fold line, a score line, a perforation line and an ablation line, and the second weakening zone may comprise a cut line, such as a substantially U-shaped cut line, extending between the first and second ends of the first weakening zone.

In those embodiments in which the inner frame tab portion is positioned between the inner frame front wall and the selection of consumer goods, the container may further comprise an inner wrapper wrapped around the plurality of consumer goods. The inner wrapper may comprise an aperture adjacent the selection of consumer goods and adjacent the inner frame tab portion so that the inner frame tab portion can contact the selection of consumer goods through the aperture when the inner frame slides away from the box portion bottom wall.

Alternatively, the inner wrapper may comprise one or more cut lines in the inner wrapper and adjacent the inner frame tab portion to define a deformable portion of the inner wrapper, wherein the inner frame tab portion can engage the selection of consumer goods when the inner frame slides upwardly by pushing the deformable portion of the inner wrapper against the selection of consumer goods. For example, the one or more cut lines may comprise a substantially U-shaped cut line that defines a deformable flap in the inner wrapper, wherein the inner frame tab portion pushes the deformable flap against the selection of consumer goods when the inner frame slides upwardly. Alternatively, the one or more cut lines may comprise two substantially vertically extending cut lines spaced either side of the inner frame tab portion to define the deformable portion of the inner wrapper.

In those embodiments in which the inner wrapper comprises a deformable portion, the inner frame tab portion may be adhered to the deformable portion of the inner wrapper to facilitate the engagement of the inner frame tab portion and the deformable portion of the inner wrapper with the selection of consumer goods when the inner frame slides upwardly and away from the box portion bottom wall.

In a further alternative, the inner wrapper may extend only partially around the consumer goods so that the inner wrapper does not extend between the inner frame tab portion and the selection of consumer goods. For example, the inner wrapper may extend only around an upper portion of the consumer goods within the container.

As described above, in the second set of embodiments the inner frame tab portion and the deformable portion of the inner wrapper (where present) engage an intermediate portion of each of the selection of consumer goods when the inner frame slides upwardly and away from the box portion bottom wall. Preferably, the intermediate portion is an edge formed by a step change in the width or diameter of each of the consumer goods. For example, in some embodiments the plurality of consumer goods comprises a plurality of aerosol-generating articles, the selection of consumer goods is a selection of the aerosol-generating articles, and the inner frame tab portion is arranged to engage an edge of a wrapper forming part of each of the selection of aerosol-generating articles. In such embodiments, each aerosol-generating article may comprise an aerosol-generating substrate, a mouthpiece, and a tipping paper wrapped around the mouthpiece and a portion of the aerosol-generating substrate, wherein the inner frame tab portion is arranged so that a distal end of the inner frame tab portion distal from the first weakening zone engages an edge of the tipping paper of each aerosol-generating article in the selection of aerosol-generating articles.

In any of the embodiments of the invention described above, the selection of consumer goods may comprise about 25 percent or less of the total number of consumer goods within the container. The selection of consumer goods may be less than about 4 consumer goods. The selection of consumer goods may be a single consumer good.

In any of the embodiments described above in which the container comprises an inner wrapper wrapped around the plurality of consumer goods, the inner wrapper may be formed from metal foil or metallised paper. The inner wrapper material may be formed as a laminate of a metallised polyethylene film, and a liner material. The inner wrapper material may be a super-calendered glassine paper. In addition, the inner wrapper material may be provided with a print-receptive top coating. The inner wrapper preferably has an access opening through which the consumer goods can be removed when the lid portion is in the open position.

In any of the embodiments described above, the container may comprise an outer wrapper, which is preferably a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. Additionally, or alternatively, the outer wrapper may be printed with images, consumer information or other data.

The container is preferably a rectangular parallelepiped comprising two wider walls spaced apart by two narrower walls. Containers according to the invention may be in the shape of a rectangular parallelepiped, with right-angled longitudinal and right-angled transverse edges. Alternatively, the container may comprise one or more rounded longitudinal edges, rounded transverse edges, bevelled longitudinal edges or bevelled transverse edges, or combinations thereof. For example, the container according to the invention may comprise, without limitation:

- One or two longitudinal rounded or bevelled edges on the front wall, and/or one or two longitudinal rounded or bevelled edges on the back wall.
- One or two transverse rounded or bevelled edges on the front wall, and/or one or two transverse rounded or bevelled edges on the back wall.
- One longitudinal rounded edge and one longitudinal bevelled edge on the front wall, and/or one transverse rounded edge and one transverse bevelled edge on the back wall.
- One or two transverse rounded or bevelled edges on the front wall and one or two longitudinal rounded or bevelled edges on the front wall.
- Two longitudinal rounded or bevelled edges on a first side wall or two transverse rounded or bevelled edges on the second side wall.

Where the container comprises one or more bevelled edge, preferably the bevelled edge has a width of between about 1 mm and about 10 mm, preferably between about 2 and about 6 mm. Alternatively, the container may comprise a multi-bevelled edge formed by parallel creasing or scoring lines that are spaced such that two or more distinct bevels are formed on at least one edge of the container.

Alternatively, the container may have a non-rectangular transversal cross section, for example polygonal such as triangular or hexagonal, semi-oval or semi-circular.

In any of the embodiments described above, the plurality of consumer goods may comprise a plurality of aerosol-generating articles. The consumer goods may comprise elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Through an appropriate choice of the dimensions, containers according to the invention may be designed to hold different total numbers of smoking articles, or different arrangements of smoking articles. For example, through an appropriate choice of the dimensions, containers according to the invention may be designed to hold a total of between ten and thirty smoking articles.

The smoking articles may be arranged in different collations, depending on the total number of smoking articles.

Containers according to the present invention may hold smoking articles of the same type or brand, or of different types or brands. In addition, both filter-less smoking articles and smoking articles with various filter tips may be contained, as well as smoking articles of differing length (for example, between about 40 mm and about 180 mm), diameter (for example, between about 4 mm and about 9 mm). Preferably, the dimensions of the container are adapted to the length of the smoking articles, and the collation of the smoking articles. Typically, the outer dimensions of the container are between about 0.5 mm to about 5 mm larger than the dimensions of the bundle or bundles of smoking articles housed inside the container.

The height, width and depth of containers according to the invention may be such that the resultant overall dimensions of the container are similar to the dimensions of a typical disposable pack of twenty cigarettes.

The exterior surfaces of containers according to the invention may be printed, embossed, debossed or otherwise embellished with manufacturer or brand logos, trade marks, slogans and other consumer information and indicia.

Container according to the present invention may be formed from one or more folded laminar blanks. Preferably, the box portion and the lid portion are formed from a single folded laminar blank. The inner frame may be formed from the same laminar blank as the box portion and the lid portion. Alternatively, the inner frame may be formed from a separate laminar blank. Laminar blanks may be formed from any suitable material or combination of materials, including, but not limited to, cardboard, paperboard, plastic, metal, or combinations thereof. Preferably, each laminar blank is a laminar cardboard blank having a weight of between about 100 grams per square meter and about 350 grams per square meter. In preferred embodiments, each laminar blank has a thickness of from about 100 micrometers to about 500 micrometers, preferably from about 200 micrometers to about 350 micrometers.

The invention will be further described, by way of example only, with reference to the accompanying drawings in which:

FIG. 3 shows a bottom perspective view of the inner frame and wrapped consumer goods of FIG. 2;

FIG. 4 shows a bottom view of the inner frame and wrapped consumer goods of FIG. 2 showing a first configuration of the inner wrapper;

Figure 1:
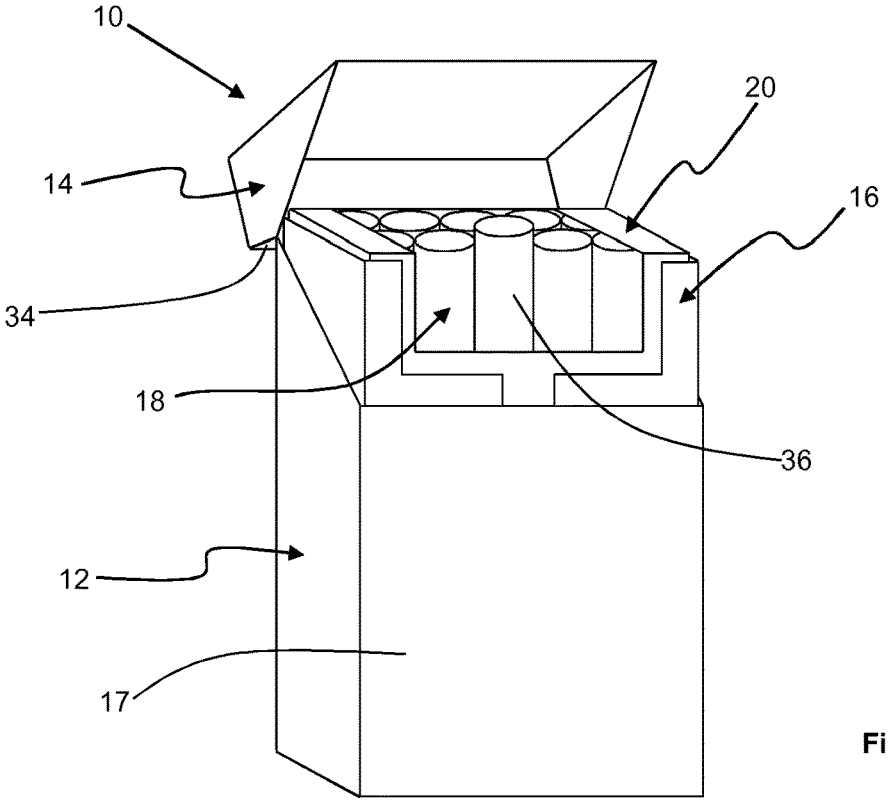
FIG. 1 shows a top perspective view of a container in accordance with an embodiment of the present invention.

FIG. 1 shows a container 10 of consumer goods according to an embodiment of the present invention. The container 10 comprises a box portion 12 and a lid portion 14 depending from the box portion 12 along a hinge line across a back wall of the container. An inner frame 16 is slidably received within the box portion 12 and provides a surface against which the lid portion 14 closes. A plurality of consumer goods 18 comprising a bundle of smoking articles is received within the inner frame 16, the plurality of consumer goods 18 wrapped in an inner wrapper 20 positioned between the plurality of consumer goods 18 and the inner frame 16.

Figure 2:
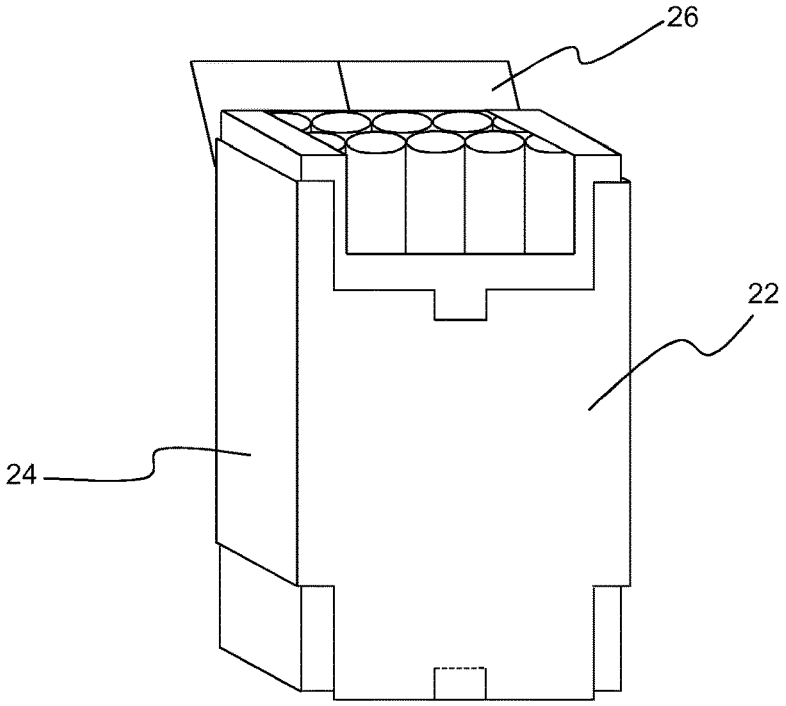
FIG. 2 shows the container of FIG. 1 with the box portion and lid portion removed to reveal the inner frame and wrapped consumer goods.

As shown more clearly in FIGS. 2 and 3, which show the container 10 of FIG. 1 with the box portion 12 and the lid portion 14 removed, the inner frame 16 comprises an inner frame front wall 22, a first inner frame side wall 24, a second inner frame side wall, an inner frame back wall 26, and an inner frame tab portion 28 depending along a first weakening zone 30 from a bottom edge 32 of the inner frame front wall 22. The inner frame tab portion 28 is folded along the first weakening zone 30 through an angle of about 90 degrees with respect to the inner frame front wall 22 so that the inner frame tab portion 28 is positioned between the bottom of the wrapped bundle of consumer goods 18 and a box portion bottom wall.

A portion of the inner frame back wall 26 is adhered to a lid portion back wall 34 so that, when the lid portion 14 is rotated into the open position shown in FIG. 1, the inner frame 16 is automatically lifted upwardly and away from the box portion bottom wall. As the inner frame 16 slides upwardly, the inner frame tab portion 28 engages with a bottom end of a selection of consumer goods to lift the selection of consumer goods upward relative to the remainder of the consumer goods, therefore making it easier for a consumer to grasp the selection of consumer goods. In the embodiment shown in FIG. 1, the inner frame tab portion 28 engages with a single smoking article 36 to lift the single smoking article 36 upwardly when the lid portion 14 is rotated into the open position. The connection between the inner frame back wall 26 and the lid portion back wall 34 also functions as a retaining mechanism to prevent the inner frame 16 from sliding entirely out of the box portion 12.

As shown in FIG. 3, the inner frame 16 further comprises second and third weakening zones 38, 40 in the form of cut lines and a fourth weakening zone 42 in the form of a score line in the inner frame front wall 22. A foldable portion 44 of the inner frame front wall 22 is defined between the first, second, third and fourth weakening zones. In the event that the inner frame tab portion 28 rotates about the first weakening zone 30 and interferes with the box portion bottom wall during downward sliding motion of the inner frame 16, the foldable portion 44 of the inner frame front wall 22 may rotate inwardly about the fourth weakening zone 42 and away from a box portion front wall 17 to ensure that the inner frame 16 can slide fully downwards to permit closing of the lid portion 14.

FIG. 4 shows a bottom view of the inner frame 16 and the inner wrapper 20 showing a first configuration of an inner wrapper bottom wall 46. In the first configuration shown in FIG. 4, a cut-out forms an aperture 48 in the inner wrapper bottom wall 46 so that the inner frame tab portion 28 can engage the selection of consumer goods through the aperture 48.

Figure 5:
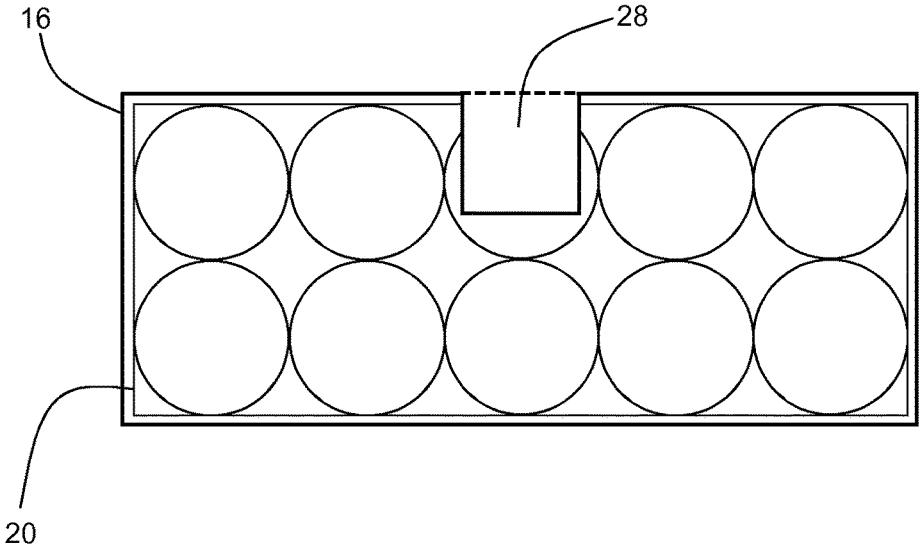
FIG. 5 shows a bottom view of the inner frame and wrapped consumer goods of FIG. 2 showing a second configuration of the inner wrapper.

In a second configuration shown in FIG. 5, the inner wrapper 20 does not comprise an inner wrapper bottom wall, so that the inner frame tab portion 28 can directly engage the selection of consumer goods without the need to provide a dedicated cut-out in the inner wrapper 20.

Figure 6:
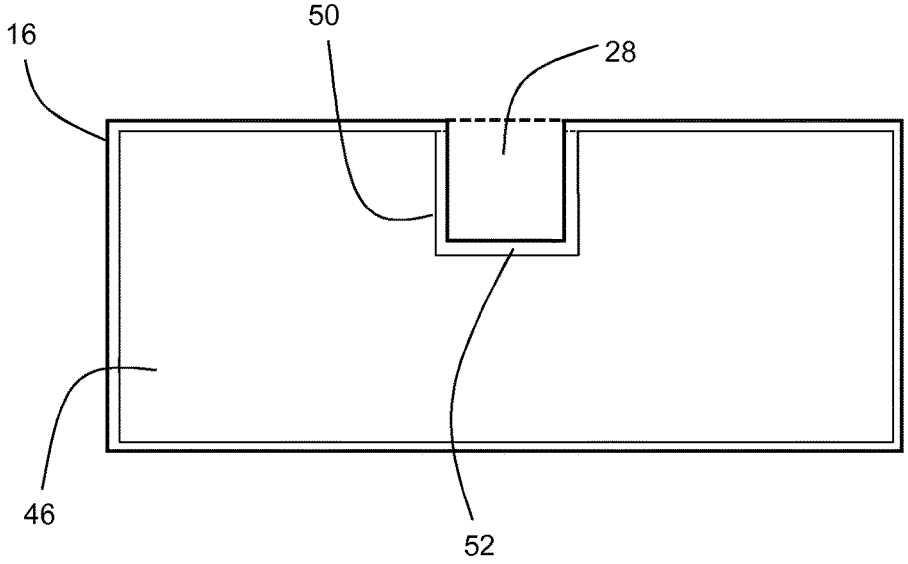
FIG. 6 shows a bottom view of the inner frame and wrapped consumer goods of FIG. 2 showing a third configuration of the inner wrapper.

In a third configuration shown in FIG. 6, the inner wrapper 20 comprises a weakening zone 50 in the form of a U-shaped cut line in the inner wrapper bottom wall 46, wherein the U-shaped cut line forms a movable flap 52 in the inner wrapper bottom wall 46 so that the inner frame tab portion 28 engages the selection of consumer goods by pushing against the movable flap 52.

The invention claimed is:

1. A container for consumer goods, comprising:

an outer housing comprising a box portion and a lid portion depending from the box portion along a hinge line;

a plurality of consumer goods received within the box portion;

an inner frame slidably received within the outer housing and positioned between the plurality of consumer goods and the box portion, the inner frame comprising an inner frame front wall underlying a box portion front wall, and a tab portion positioned between a box portion bottom wall and an end of each of a selection of the plurality of the consumer goods, the tab portion depending along a first weakening zone from a bottom edge of the inner frame front wall, wherein the tab portion is arranged such that sliding the inner frame away from the box portion bottom wall engages the tab portion with the selection of consumer goods and lifts the selection of consumer goods away from the box portion bottom wall; and an inner wrapper wrapped around the plurality of consumer goods, the inner wrapper comprising an aperture underlying the selection of consumer goods and overlying the inner frame tab portion so that the inner frame tab portion can contact the selection of consumer goods through the aperture when the inner frame slides away from the box portion bottom wall.

2. A container according to claim 1, wherein the inner frame further comprises:

an inner frame back wall opposite the inner frame front wall, wherein the plurality of consumer goods are positioned between the inner frame front wall and the inner frame back wall; and first and second inner frame side walls each extending between the inner frame front wall and the inner frame back wall;

wherein the inner frame back wall is connected to the lid portion so that rotation of the lid portion about the hinge line from a closed position to an open position automatically slides the inner frame away from the box portion bottom wall.

3. A container according to claim 1, further comprising a retaining mechanism configured to limit the range of sliding motion of the inner frame to prevent the inner frame from sliding entirely out of the box portion when the inner frame slides away from the box portion bottom wall.

4. A container according to claim 1, wherein the inner frame further comprises a cut-out in the inner frame front wall and extending from a top edge of the inner frame front wall, the cut-out having substantially the same size and shape as the inner frame tab portion.

5. A container according to claim 1, wherein the inner frame tab portion is folded about the first weakening zone through an angle of between 85 degrees and 95 degrees with respect to the inner frame front wall so that the inner frame tab portion is substantially parallel to the box portion bottom wall.

6. A container according to claim 1, wherein the aperture in the inner wrapper is substantially the same size as the box portion bottom wall so that none of the inner wrapper is positioned between the plurality of consumer goods and the box portion bottom wall.

7. A container according to claim 1, wherein a portion of the inner wrapper is positioned between some of the plurality of consumer goods and the box portion bottom wall to define an inner wrapper bottom wall, and wherein the aperture is an aperture in the inner wrapper bottom wall.

8. A container according to claim 1, wherein the inner frame further comprises second and third weakening zones each extending from the first weakening zone and across a portion of the inner frame front wall.

9. A container according to claim 1, wherein the maximum height of the inner frame front wall is between 70 percent and 130 percent of the maximum height of the box portion front wall.

10. A container according to claim 1, wherein the box portion and the lid portion are formed from a first folded laminar blank, and wherein the inner frame is formed from a second folded laminar blank.

11. A container according to claim 1, wherein the plurality of consumer goods comprises a plurality of aerosol-generating articles.

* * * * *